United States Patent [19]

Fox et al.

[11] 4,225,759

[45] Sep. 30, 1980

[54] HIGH VOLTAGE DISTRIBUTOR UTILIZING A HIGH DIELECTRIC FLUID MEDIUM

[75] Inventors: David H. Fox, Ann Arbor; Robert L. Kuhn, Dearborn, both of Mich.

[73] Assignee: Ford Motor Company, Dearborn, Mich.

[21] Appl. No.: 853,698

[22] Filed: Nov. 21, 1977

[51] Int. Cl.[3] ..... H01H 19/00

[52] U.S. Cl. ..... 200/19 M; 200/26; 200/28; 123/146.5 A

[58] Field of Search ..... 200/19 R, 19 A, 19 DR, 200/19 DC, 19 M, 24, 25, 26, 28, 8 R, 8 A; 123/146.5 A; 335/205, 206

[56] References Cited

U.S. PATENT DOCUMENTS

| | | | |
|---|---|---|---|
| 2,291,652 | 8/1942 | Rose | 200/19 M |
| 2,444,325 | 6/1948 | Arthur | 200/19 A |
| 2,584,907 | 2/1952 | Nelson | 200/19 M |
| 2,825,768 | 3/1958 | Beck | 200/24 |
| 3,197,579 | 7/1965 | Rumney | 200/8 A X |
| 3,263,033 | 7/1966 | Metzger | 200/8 A |
| 3,564,167 | 2/1971 | Armytage | 200/8 R |
| 3,697,981 | 10/1972 | Harkins et al. | 200/8 A UX |

FOREIGN PATENT DOCUMENTS

| | | | |
|---|---|---|---|
| 488570 | 7/1938 | United Kingdom . | |
| 533232 | 2/1941 | United Kingdom . | |
| 584823 | 1/1947 | United Kingdom | 200/19 M |
| 1040571 | 9/1966 | United Kingdom . | |

*Primary Examiner*—James R. Scott

*Attorney, Agent, or Firm*—Paul K. Godwin, Jr.; Clifford L. Sadler

[57] ABSTRACT

A high voltage distributor is reduced significantly in size by utilizing a dielectric fluid medium having a high dielectric constant between adjacent spark plug contacts. The distributor includes a fluid-tight chamber which contains the fluid medium, a rotor, a common high voltage supply contact and a plurality of spark plug contacts concentrically disposed to provide a metal-to-metal conduction path with the rotor. The rotor defines an electrically conducting path between the common high voltage supply contact and sequentially selected spark plug contacts, and contains a magnetic element which is magnetically coupled to a corresponding magnet at one end of a rotationally driven shaft, located external to the fluid-tight chamber.

13 Claims, 3 Drawing Figures

HIGH VOLTAGE DISTRIBUTOR UTILIZING A HIGH DIELECTRIC FLUID MEDIUM

BACKGROUND OF THE INVENTION

1. Field of the Invention

The present invention is directed to the field of high speed sequential switching of high voltage discharge current from a common supply to a plurality of individual output terminals. More specifically, the present invention is directed to an improved miniaturized distributor, such as the type employed in automotive ignition systems, which overcomes problems of arc-over by employing a fluid medium having a relatively high dielectric constant surrounding the contact areas.

2. Description of the Prior Art

As internal combustion engines were developed to use higher ignition spark energy, in the range of 40,000 volts, over longer burn times, it was found that high voltage arc-over sometimes occurred between the rotor contact and a plurality of adjacent spark plug contacts in conventional distributors having air dielectrics. For instance, if the rotor contact was not in proper registration with the selected spark plug contact at the time high voltage was applied to the rotor contact, dielectric breakdown would occur and result in conduction between the rotor contact and the wrong spark plug contact, thereby causing engine misfire.

Development of a distributor, such as that shown in U.S. Pat. No. 3,799,135, was made, in which erroneous discharge was eliminated by providing a multi-legged spider-type high voltage conductor in arc-gap relationship with corresponding spark plug contacts separated by a rotating element. The rotating element was constructed of a solid insulating material with an air dielectric window formed therethrough. As the element was rotating, the window allowed arc-gap conduction between the corresponding spider leg and spark plug contact, while the solid insulating material, having a high dielectric constant, prevented simultaneous discharge-conduction to other spark plug contacts.

Additional progress in electronic ignition controls, such as that disclosed in commonly assigned U.S. Pat. No. 3,969,614, led to the invention of a new type distributor disclosed and claimed in commonly assigned U.S. patent application No. 803,197, filed June 3, 1977 now U.S. Pat. No. 4,153,030. That air dielectric distributor invention eliminated conventional vacuum and centrifugal advance mechanisms by providing wide angles of registration between a conductive rotor element and respective spark plug contacts. The invention also eliminated the need to increase the diameter of the distributor, in order to provide a large air dielectric spacing between the conducting contacts, by arranging the contacts in a plurality of stacked sets separated sufficiently to eliminate erroneous arc-over.

SUMMARY OF THE INVENTION

The present invention overcomes the restrictions placed on the prior art, with respect to miniaturization of diameter and height dimensions, while at the same time incorporating the advantageous elimination of erroneous arc-over and the advantageous wide angle registration between the rotor and spark plug contacts.

In each of the prior art references discussed above, large path lengths were maintained between conducting members so as to prevent break-down of the air dielectric and the resultant erroneous arc-over. The necessary air dielectric separation for 40,000 volts is approximately 0.800 inch (2.03 cm). Therefore, for a single plane of spark plug contacts arranged circumferentially to provide 30° of registration between a rotor contact and each spark plug contact in an air dielectric distributor used in an 8-cylinder engine, the diameter of the contact circle must be at least 6.1 inches (15.5 cm).

One embodiment of the present invention utilizes a fluid dielectric medium having a dielectric constant approximately 2.5 times larger than that of air and allows the contact circle diameter, for an 8-cylinder contact circle with 30° registration, to be reduced to approximately 2.44 inches (6.20 cm).

Of course, further diameter reductions can also be achieved if the number of spark plug contacts are divided into sets and vertically stacked along the rotor axis, as is suggested in the aforementioned commonly assigned application. However, such a vertical separation of contacts will result in a corresponding increase in the height dimension, with respect to the improved distributor embodiment discussed below.

Briefly, the present invention achieves the above advantages by providing a sealed unit which contains the spark plug contacts, a common high voltage supply contact and a fluid-tight chamber. The fluid-tight chamber contains a rotor element, which provides a metal-to-metal conduction path between sequentially selected spark plug contacts and the high voltage contact while substantially floating in a relatively high dielectric fluid medium. The rotor also contains a magnetic element and is magnetically coupled to a like magnetic element mounted on a driven shaft located external to the chamber. These magnetic elements provide for accurate rotor registration due to precise magnetic alignment coupling.

Accordingly, it is an object of the present invention to provide a miniaturized distributor that eliminates occurrences of spurious arc-over between conducting elements.

It is another object of the present invention to provide an improved distributor that eliminates the need for vacuum or centrifugal advance mechanisms by providing a wide angle metal-to-metal conduction registration between its rotor and individual spark plug contacts.

It is a further object of the present invention to provide a high dielectric medium in intimate contact with the rotor and spark plug contacts, and to provide a metal-to-metal conduction path between said contacts.

DESCRIPTION OF THE PREFERRED EMBODIMENT

Figure 1:
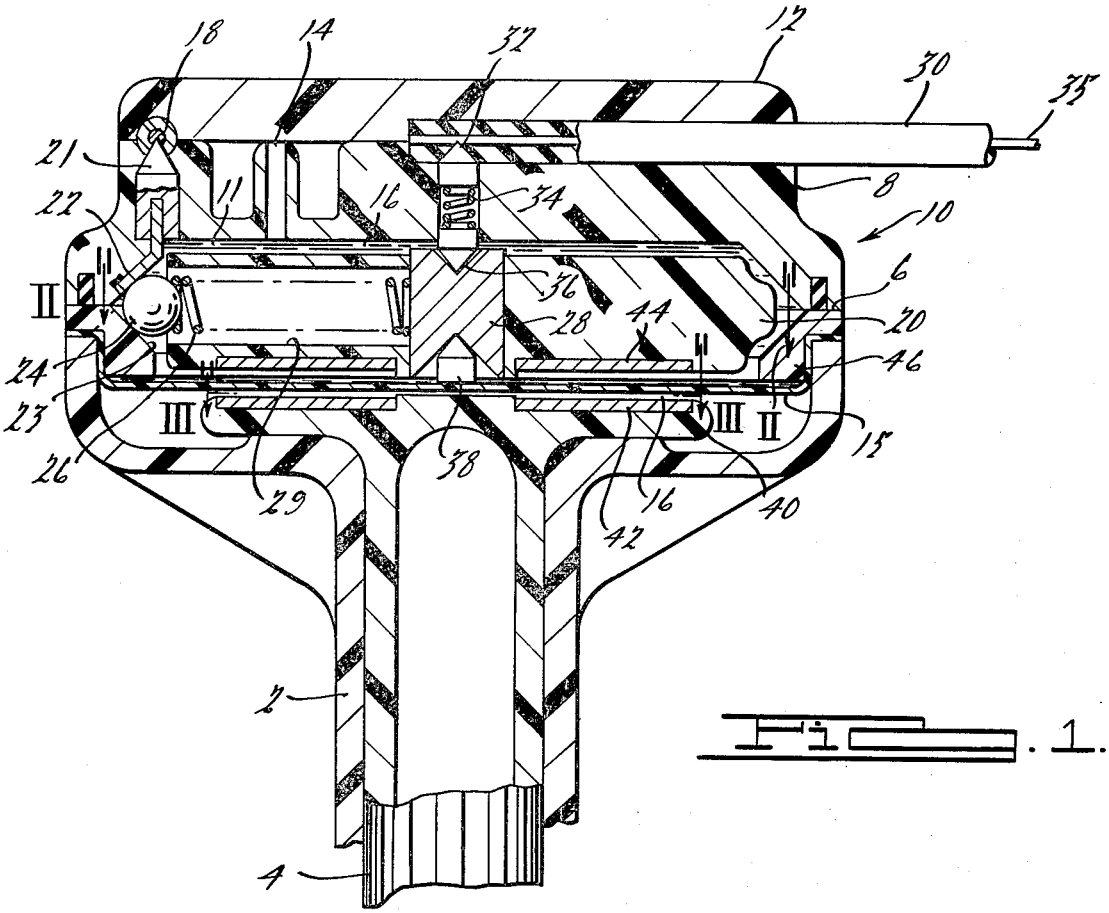
FIG. 1 is a cross-sectional view of a preferred embodiment of the present invention.

FIG. 1 illustrates the present invention as a high voltage switch, commonly referred to as a distributor. Distributors of this type are ideally suited for use with internal combustion engines to provide the sequential switching of high voltage from the secondary of an ignition coil to individual spark plugs. The present invention is described below as being associated with an 8-cylinder engine having a single spark plug mounted in each cylinder. It should be understood that the present invention is equally well suited for use in engines having other numers of cylinders, while contributing the same recited advantages over the prior art distributors.

The illustrated distributor embodiment of the present invention includes a housing 10, which is mounted on a support base 2. The support base 2 is rigidly attached to an engine (not shown) and acts as a bushing for a driveshaft 4, which extends therethrough. The shaft 4 is rotationally driven by the engine (not shown) in proportional synchronization therewith.

The housing 10 includes a rotor cap 8, a wire cap 12 and a rotor support 15. The rotor cap 8 and the rotor support 15 are sealed together about their peripheral edges 6 to define a fluid-tight chamber 11. The rotor cap 8 contains a plurality of arcuate spark plug contacts 22 (eight in this embodiment) circumferentially disposed around the chamber 11. The spark plug contacts 22 are electrically connected to corresponding output terminals 21. The terminals 21 each have a pointed end to penetrate a corresponding spark plug wire 18, when it is compressed into position by the attachment of the wire cap 12 to the rotor cap 8. The rotor cap 8 also includes a centrally mounted, electrically conductive needle bearing 36 extending into the chamber 11 from an upper portion thereof. The upper needle bearing 38 is spring biased downward by an electrically conductive coil spring 34. The upper end of the spring 34 is compressed against a rigidly mounted high voltage terminal 32. The terminal 32 is pointed to penetrate into the high voltage wire 35 from the secondary of the ignition coil, when the wire cap 12 is compressed into position.

Figure 2:
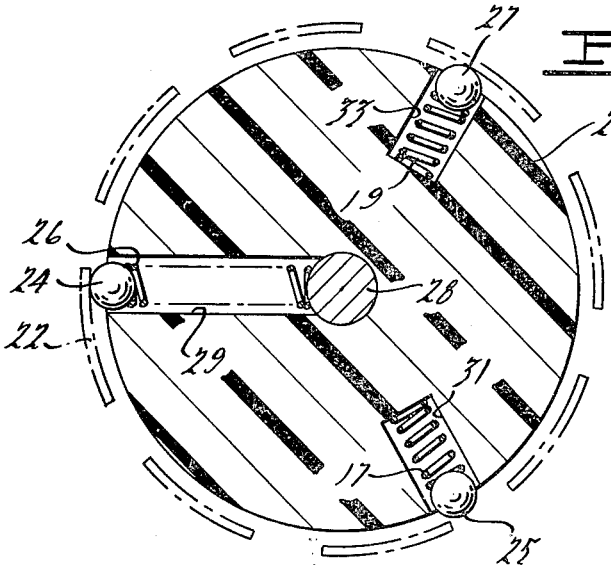
FIG. 2 is a cross-sectional view of the rotor element shown in FIG. 1 and taken along the lines II—II.

A rotor element 20 is sealed within the chamber 11 and mounted for rotation about an axis extending between the upper needle bearing 36 and a lower needle bearing 38. The lower needle bearing 38 extends upward from the rotor support 15. The rotor element 20 has a molded body portion of an insulating material surrounding a central electrically conductive post 38. The post 38 has two inverted conical bearing support surfaces for rotational mating with needle bearings 36 and 38. A conduit 29 extends from the post 38 to the outer periphery of rotor 20 for the purpose of containing an electrically conductive biasing spring 26 and a radially outward biased ball bearing 24. The ball bearing 24 is also electrically conductive and is biased to contact the circular sidewalls 23 of the chamber 11. The circular sidewalls 23 serve as a race for the ball bearing 24, as well as for ball bearings 25 and 27 shown in FIG. 2.

The bearings 25 and 27 are respectively located in radially extending canals, which extend only partially into the rotor 20. Biasing springs 17 and 19, respectively, force the bearings 25 and 27 towards the sidewalls 23 of the chamber 11. Due to the equiangular location about the rotor 20, the bearings 25 and 27 contribute to the balanced support of the rotor 20 along with the conducting bearing 24.

The remainder of the chamber 11 is occupied by the fluid medium 16 having a relatively high dielectric constant, as compared to an air medium, and a low viscosity. A fluid medium 16, found to be highly desirable for use in this invention, is a fluorinated hydrocarbon liquid manufactured under the trademark FREON-12. This liquid has a dielectric constant, approximately 2.5 times higher than that of air, and a relatively low viscosity, to allow free rotor rotation. Other compounds, such as those including silicon, may also be selected as a fluid medium 16. The general requirements, are that they have relatively high dielectric constants, as compared to that of air, maintain their dielectric properties over a long period of time and have low viscosity properties over a wide range of environmental temperatures.

In each case, the fluid medium 16 is added to the chamber 11 through a fill port 14, which extends through the rotor cap 8 and is sealed to prevent entry of air into the chamber 11.

The fluid medium 16 functions to provide a high dielectric between adjacent spark plug contacts 22, while allowing metal-to-metal contact between the bearing 24 and any given spark plug contact 22 in registration therewith. The high dielectric fluid medium 16 also enables a reduction in adjacent spark plug contact spacing, as compared to an air medium. This ability to reduce the contact spacing is a key factor in reducing the diametric size of the distributor and achieving miniaturization thereof, while allowing the same 30° registration angle to be maintained for an 8-cylinder engine. Of course, the above indicated miniaturization is achieved without introducing possible arc-over problems between spaced contacts.

The extremes of advancement and retardation of the spark, ultimately supplied to individual ones of the eight spark plugs, in this type of distributor have been described as being controlled to occur within a range of approximately 30°. Therefore, a metal-to-metal contact path is provided between the bearing 24 and each sequentially selected spark plug contact 22 over a registration angle of approximately 30°. This metal-to-metal contact occurs due to the fact that the spark plug contacts 22 are arcuate in shape and are molded into the sidewall of the chamber 11 so as to have one surface exposed to the chamber 11. The opposite surface of each of the spark plug contacts 22 is insulated by the rotor cap 18. Therefore, as the rotor 20 rotates within the chamber 11, the roller bearing 24 acts to displace the fluid medium 16 and achieve metal-to-metal contact when in a registered position, thereby eliminating pitting and other contact deteriorations.

Figure 3:
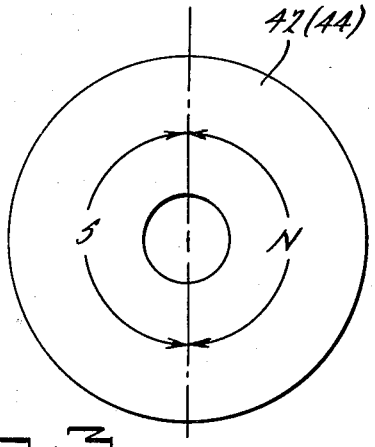
FIG. 3 illustrates the disc type magnets used in both the rotor element and the driveshaft shown in FIG. 1, and taken along lines III—III.

A disc-shaped magnet 44 (FIG. 3), defining north and south poles, is fixedly embedded in the lower portion of the rotor 20, in order that the rotor can be correctly oriented for synchronous registration and so that rotational driving force may be applied thereto. The magnet 44 is centered about the aforementioned axis and is adjacent the upper surface of the rotor support 15. Another disc-shaped magnet 42, defining north and south poles, is disposed on the end of the driveshaft 4 adjacent the lower surface of the rotor support 15, so as to establish magnetic coupling between magnets, to provide for precise rotor registry and allow the rotational driving force to be communicated from the driveshaft 4 to the rotor 20.

The housing 10 is securely mounted, such as by detachable clips (not shown), to the support base 2 in a manner that will prevent rotation of the housing 10 with respect to the base 2, after initial timing adjustments have been made.

It will be apparent that many modifications and variations may be affected without departing from the scope of the novel concept of this invention. Therefore, it is intended by the appended claims to cover all such modifications and variations which fall within the true spirit and scope of the invention.

We claim:

1. A distributor for sequentially switching high voltage supplied at a common terminal to individually selected output terminals comprising:

housing means for mounting said common and output terminals and for defining a fluid-tight cavity;

rotor means mounted for rotation about an axis within said defined cavity in electrical contact with said common terminal and providing an electrically conducting path from said common terminal and individually selected output terminals;

said rotor means also includes a permanent magnet, defining north and south poles orthogonal to said axis, mounted for magnetic communication with an externally generated magnetic field;

shaft means for communicating rotational driving force to said rotor means, wherein said shaft means includes a first end having a permanent magnet, defining north and south poles oppositely corresponding to said rotor magnet, positioned adjacent said housing to provide said externally generated magnetic field; and a dielectric fluid having a dielectric constant greater than that of air, occupying the remainder of said cavity.

2. The distributor as in claim 1, wherein said housing means includes:

circumferentially arranged contacts disposed within said cavity correspondingly electrically connected to said output terminals and;

a centrally located contact electrically connected to said common terminal.

3. A distributor for sequentially switching high voltage supplied at a common terminal to individually selected output terminals comprising:

housing means for mounting said common and output terminals and for defining a fluid-tight cavity;

rotor means mounted for rotation about an axis within said defined cavity in electrical contact with said common terminal and individually selected output terminals;

said rotor means also includes a permanent magnet, defining north and south poles orthogonal to said axis, mounted for magnetic communication with an externally generated magnetic field;

shaft means for communicating rotational driving force to said rotor means, wherein said shaft means includes a first end having a permanent magnet, defining north and south poles oppositely corresponding to said rotor magnet, positioned adjacent said housing to provide said externally generated magnetic field;

a dielectric fluid having a dielectric constant greater than that of air, occupying the remainder of said cavity;

said housing means includes circumferentially arranged contacts disposed within said cavity correspondingly electrically connected to said output terminals and a centrally located contact electrically connected to said common terminal;

said axis extends through said centrally located contact, said circumferentially arranged contacts are disposed within said cavity concentric about said axis; and said rotor means includes an electrically conducting ball bearing for individually contacting selected ones of said circumferentially arranged contacts and an electrically conducting mounting post electrically contacting said spring.

4. An automotive distributor for sequentially switching a high voltage supply through a common terminal to individual ones of a plurality of output terminals in synchronization with the speed of an associated engine, comprising:

shaft means having a permanent magnet mounted on one end thereof being connected to said engine for communicating drive rotation forces about an axis in proportional synchronization therewith;

means surrounding said shaft means for housing said distributor;

means within said housing means defining a circular chamber concentric with said axis, having defined upper and lower portions and including a lower bearing centrally protruding into said lower chamber portion;

means within said chamber defining a plurality of separate arcuate contacts respectively electrically connected to corresponding output terminals;

means within said chamber defining a common contact including an electrically conductive bearing centrally protruding into said upper chamber portion coaxial with said lower bearing, electrically connected to said common terminal;

rotor means mounted within said chamber for rotation about said axis and for providing sequential and separate electrical connections between said common contact and said arcuate contact wherein said rotor means includes a permanent magnet mounted therein for alignment and communication with said shaft means magnet to receive said drive rotation forces therefrom; and liquid means occupying the remainder of said chamber for providing a dielectric medium having a dielectric constant greater than that of air.

5. A distributor as in claim 4, wherein said arcuate contacts are eight in number and each define at least a 30° arc having its center at said axis.

6. A distributor as in claim 5, wherein said fluid medium comprises a fluorinated hydrocarbon liquid and said medium has a dielectric constant approximately 2.5 times greater than that of air.

7. A distributor as in claim 4, wherein said rotor means includes a centrally located bearing contact element with surfaces respectively contacting said upper and lower bearings for rotation thereabout.

8. A distributor as in claim 7, wherein said bearing contact element is made of electrically conductive material and is continuously electrically connected to said upper bearing.

9. A distributor as in claim 8, wherein said chamber defining means also defines a circumferential race sidewall surface, within said chamber, to include said arcuate contacts, and said rotor means further includes an electrically conducting roller bearing bias-mounted radially with respect to said contact element to contact said race surface.

10. A distributor as in claim 9, wherein said rotor means includes a radial channel extending from said contact element to said roller bearing and also includes a spring member to provide radially outward biasing to said roller bearing and electrically conductive path between said contact element and said roller bearing.

11. A distributor as in claim 8, wherein said rotor includes a magnetically polarized element defining north and south poles, and said shaft means includes a corresponding magnetically polarized element defining north and south poles, whereby said magnetically polarized elements are mounted to be magnetically coupled.

12. A distributor as in claim 11, wherein said magnetically polarized element of said shaft means is external to said chamber defining means.

13. A distributor as in claim 12, wherein said magnetically polarized elements are coaxially aligned circular disc shaped permanent magnets.

* * * * *

UNITED STATES PATENT AND TRADEMARK OFFICE

CERTIFICATE OF CORRECTION

PATENT NO. : 4,225,759

DATED : September 30, 1980

INVENTOR(S) : David H. Fox et al

It is certified that error appears in the above-identified patent and that said Letters Patent are hereby corrected as shown below:

Claim 3, column 5, following the last line, insert --an electrically conducting spring electrically contacting said ball bearing--.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*